US005964620A

United States Patent [19]

Takahashi et al.

[11] Patent Number: 5,964,620

[45] Date of Patent: Oct. 12, 1999

[54] INSULATION DISPLACEMENT CONNECTOR

[75] Inventors: Hisafumi Takahashi; Masahiro Tada, both of Tokyo, Japan

[73] Assignee: Kel Corporation, Tokyo, Japan

[21] Appl. No.: 09/018,240

[22] Filed: Feb. 3, 1998

[30] Foreign Application Priority Data

Feb. 5, 1997 [JP] Japan ..... 9-022917

[51] Int. Cl.[6] ..... H01R 9/05

[52] U.S. Cl. ..... 439/579

[58] Field of Search ..... 439/404, 405, 439/579, 497

[56] References Cited

U.S. PATENT DOCUMENTS

| | | | |
|---|---|---|---|
| 4,464,003 | 8/1984 | Goodman et al. | 439/404 |
| 5,281,762 | 1/1994 | Long et al. | 174/78 |
| 5,498,172 | 3/1996 | Noda | 439/404 |

*Primary Examiner*—Steven L. Stephan
*Assistant Examiner*—Barry M. L. Standig
*Attorney, Agent, or Firm*—Robert W. J. Usher

[57] ABSTRACT

Each grounding plate 31 or 32 includes main body 31*b* or 32*b* and grounding bars 31*a* or 32*a* which extend forward from the main body 31*b* or 32*b*. The grounding bars 31*a* or 32*a* and the signal lines C*e* of coaxial cables are sandwiched between an insulation displacement piece 11 or 12 and the housing 10 to press the grounding bars 31*a* or 32*a* and the signal lines C*e* into the insulation displacement portions T*a* of the contacts T in the housing. The grounding plates 31 and 32 include barrels 33 to which the shielding wires C*c* of the coaxial cables are connected for retaining the coaxial cables C in alignment such that the shielding wires C*c* and the grounding bars 31*a* and 32*a* are electrically connected. In this way, an insulation displacement connector for coaxial cables is realized to make the connection of the coaxial cables to the contacts easy even for a multi-terminal connector and to prevent faults in the performance of the connector.

7 Claims, 6 Drawing Sheets

INSULATION DISPLACEMENT CONNECTOR

FIELD OF THE INVENTION

The present invention relates generally to an electrical connector which is used for connecting coaxial cables and more particularly to an insulation displacement connector which enables simple connection of its contacts with the coaxial cables.

BACKGROUND OF THE INVENTION

Coaxial cables are often used as a cable (electrical wire) suitable for transmission of high frequency signals. As shown in FIG. 8, in general, a coaxial cable comprises a signal line C*e* including a centrally located inner conductor C*a* and an inner insulator C*b* which surrounds the inner conductor C*a*, a flexible braided outer conductor C*c* (or shielding wires) which surrounds the inner insulator C*b*, and an outer insulator C*d*, which covers the outer conductor C*c*.

Coaxial cables C of the above construction are connected to electrical contacts of electrical connectors in various ways such as soldering, welding, or squeezing for insulation displacement. Each of these methods requires separate preparation processes for the inner conductors C*a* and for the shielding wires C*c* of the coaxial cables prior to the connection of the coaxial cables to the contacts. These redundant processes have been a problem in reducing the assembly cost of connectors for coaxial cables.

For example, the soldering method applied for connecting a coaxial cable C to electrical contacts of a connector involves several processes. As shown in FIG. 9, first, the outer insulator C*d* and the inner insulator C*b* must be stripped to expose the shielding wires C*c* and the inner conductor C*a*, respectively. Then, the exposed shielding wires C*c*, which is braided in a tubular form, must be bundled into a rope before the inner conductor C*a* and the shielding wires C*c* are soldered with solder H to the respective contacts T' and T'.

In recent years, electrical connectors have gone through multi-terminalization. As a result, connectors of the above mentioned type are designed with a plurality of contacts and are used for connecting a flat cable which comprises a plurality of coaxial cables. If the above mentioned soldering method is applied for connecting such flat cable to the contacts of an electrical connector, then the number of assembly processes required for the connection will multiply by the number of coaxial cables C used. Another problem is that the characteristics of the coaxial cables in the flat cable are affected by the uneven amount of solder applied to each coaxial cable (i.e., the performance of some coaxial cables are impaired).

SUMMARY OF THE INVENTION

The present invention is conceived to solve these problems. An object of the present invention is to provide an insulation displacement connector which enables simple connection of its contacts with coaxial cables and which prevents reduction in the performance of coaxial cables even though the connector is designed with multi-terminals.

In order to achieve this objective, the present invention embodies an insulation displacement connector which retains a plurality of coaxial cables each incorporating a signal line and shielding wires, for the connection with a matable connector. The insulation displacement connector comprises a grounding plate, a plurality of contacts, a housing which retains the contacts in a lateral alignment, and an insulation displacement piece. The grounding plate includes a main body and grounding bars which extend forward from the main body.

Each contact includes an insulation displacement portion at one end to which a grounding bar or a signal line is squeezed and a contact portion at the other end which is brought into contact with a contact of a matable connector. The insulation displacement piece and the housing sandwich the grounding bars and the signal lines to squeeze them to the insulation displacement portions. The main body includes connection retaining portions, to which the shielding wires are connected for retaining the coaxial cables in alignment. The shielding wires are connected to and retained in the connection retaining portions so that electrical connection is established between the shielding wires of the coaxial cables and the grounding bars.

In this insulation displacement connector, the shielding wires are connected to and retained in the connection retaining portions to retain the coaxial cables in alignment against the grounding plate. As the grounding bars are connected through the grounding plate to the shielding wires of the coaxial cables, the signal lines of the coaxial cables and the grounding bars are pushed into contact with the contacts in one operation when the grounding plate retaining the coaxial cables is sandwiched between the housing and the insulation displacement piece.

It is preferable that the above insulation displacement connector be designed to have one grounding bar extending between any two signal lines in the alignment when the coaxial cables are retained in the connection retaining portions. With this design, the grounding bars in the spaces between the signal lines prevent cross talks from occurring among the signal lines.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention and wherein.

DESCRIPTION OF THE PREFERRED EMBODIMENTS

Figure 1:
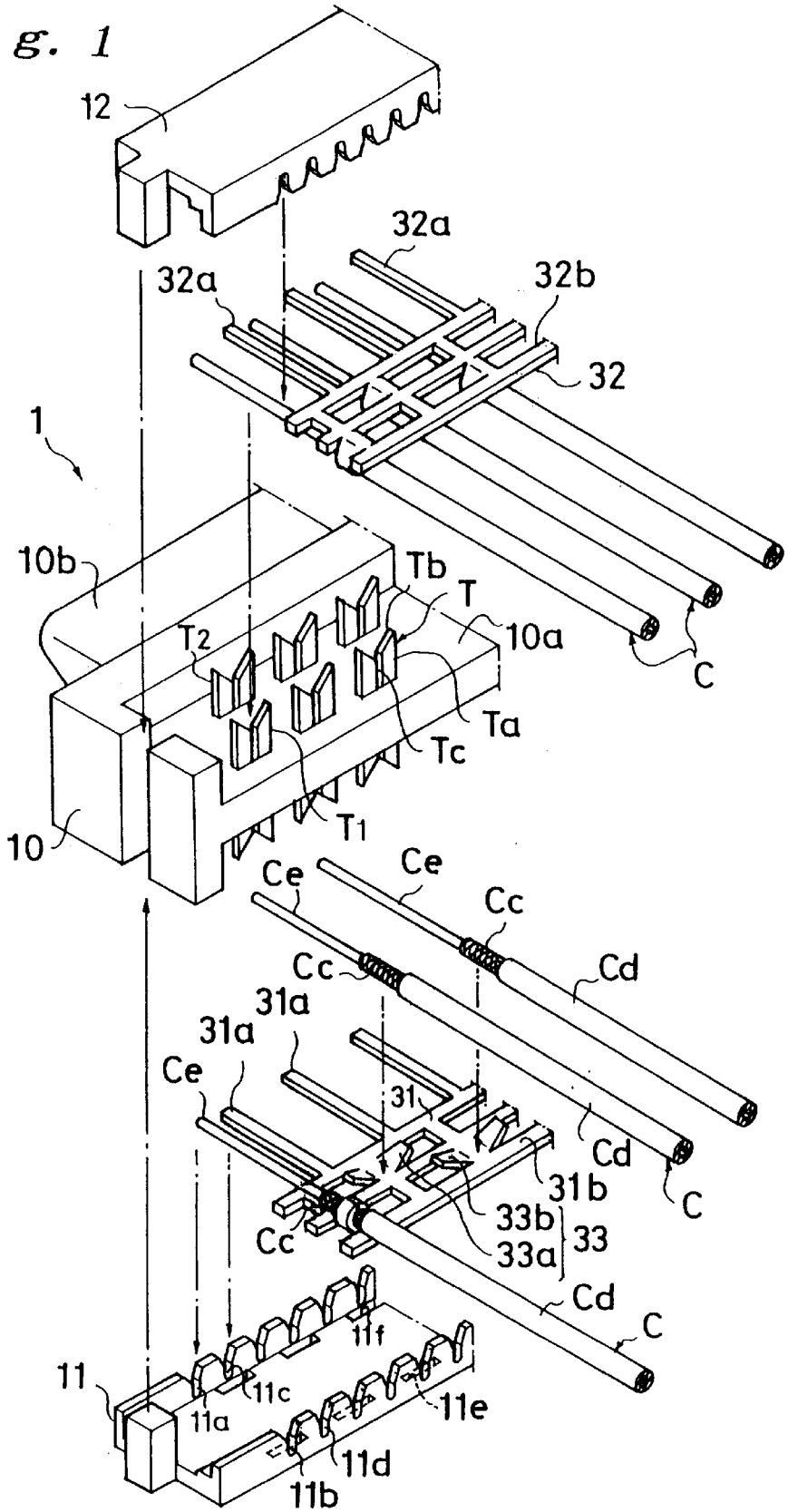
FIG. 1 is a perspective, exploded view of an insulation displacement connector according to the present invention.

With reference to the drawings, an preferred embodiment of the present invention is described. FIG. 1 shows the construction of an insulation displacement connector 1 which is used for connecting coaxial cables, according to the present invention, and FIG. 2 includes part of the external appearance of the connector 1. The connector 1 comprises a plurality of contacts T, an housing 10, upper and lower insulation displacement pieces 12 and 11, and upper and lower grounding plates 32 and 31, respectively. The housing 10 is formed of an insulative material, retaining the contacts T, with an engaging portion 10*b* which is engaged with a matable connector (not shown in the drawings). Onto the housing 10, the upper and lower insulation displacement pieces 12 and 11 and the upper and lower grounding plates 32 and 31 are mounted.

The contacts T are planar and made of an electrically conductive material. Each contact T is provided with an insulation displacement portion T*a* at one end, with which the signal line C*e* of a coaxial cable C or a grounding bar 31*a* or 32*a* of a grounding plate 31 or 32 comes into contact by pressure. Each contact T is provided also with another contact portion (not shown) at the other end, with which each contact T comes into contact with a contact (not shown) of a matable connector. The insulation displacement portions T*a* protrude from the housing 10 and are aligned over a contact-aligning surface 10*a* of the housing 10. The upper part of each insulation displacement portion T*a* is V-shaped with lateral acute portions T*b* and a slit T*c* therebetween.

The contacts T are grouped in two rows: one row for signal transmission and the other for grounding. The signal contacts T1, with which the signal lines C*e* of the coaxial cables C come into contact by pressure in insulation displacement, are aligned laterally in the rear row over the contact-aligning surface 10*a*; and the grounding contacts T2, with which the grounding bars 31*a* or 32*a* come into contact by pressure, are aligned laterally in the front row over the contact-aligning surface 10*a* (the side of the connector facing the left side of the drawing in FIG. 1 is arbitrarily assigned as the front side of the connector). Here, the pitch of the contacts T1 in the front row and that of the contacts T2 in the rear row are equal. The two rows are arranged in a zigzag pattern in plan view such that each of the grounding contacts T2 comes between any two successive signal contacts T1 in the row when viewed in the axial direction of the connector.

Into the contacts T aligned as described above, the signal lines C*e* of coaxial cables C and the grounding bars 32*a* and 31*a* of the upper and lower grounding plates 32 and 31 are pressed to establish electrical connection. The coaxial cables C used here have the same construction as the coaxial cable C described previously, so no description of the coaxial cables C is given here. Now, referring to FIG. 3 and taking the lower grounding plate 31 as an example, the upper and lower grounding plates 32 and 31 are described.

The lower grounding plate 31 is formed by punching a planar, electrically conductive material to attain a configuration which includes a main body 31*b* and a plurality of grounding bars 31*a*. Each of the grounding bars 31*a* has a shape of stick and extends forward from the main body 31*b*. The main body is in a shape of plate and has a plurality of ferrule (or connection retaining portions) 33, which are formed by bending cut parts of the main body 31*b* upward.

Figure 3A:
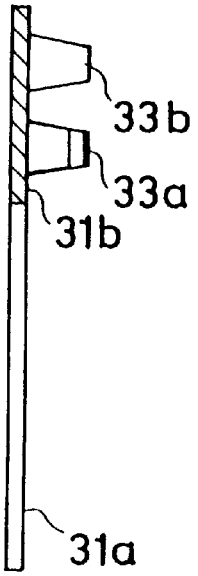
FIG. 3A is a side view of a grounding plate of the connector.
Figure 3B:
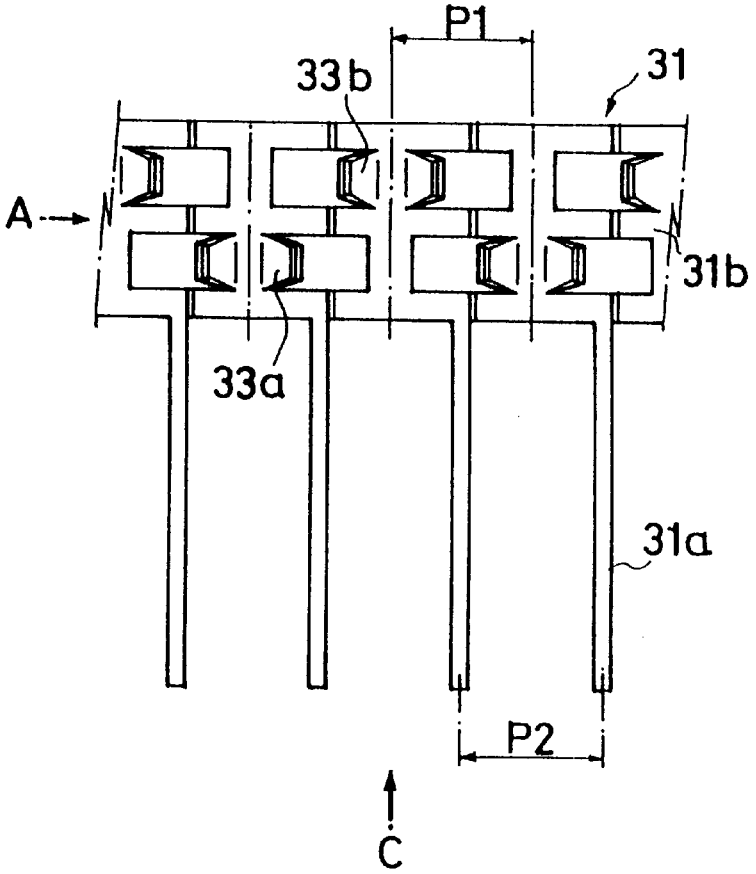
FIG. 3B is a plan view of the grounding plate.
Figure 3C:
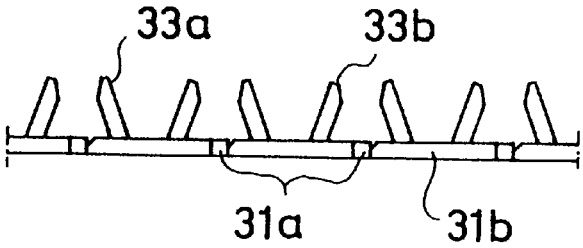
FIG. 3C is a front view of the grounding plate.
Figure 4:
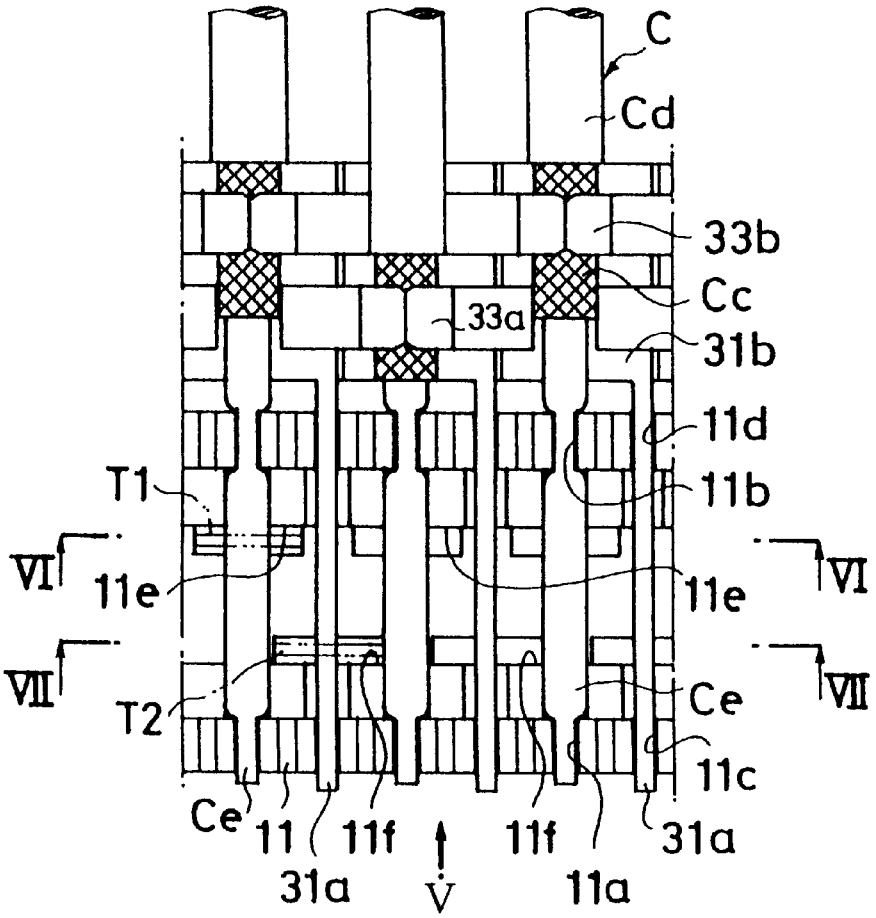
FIG. 4 is a plan view of a lower insulation displacement piece with a lower grounding plate 31 and coaxial cables C.
Figure 5:
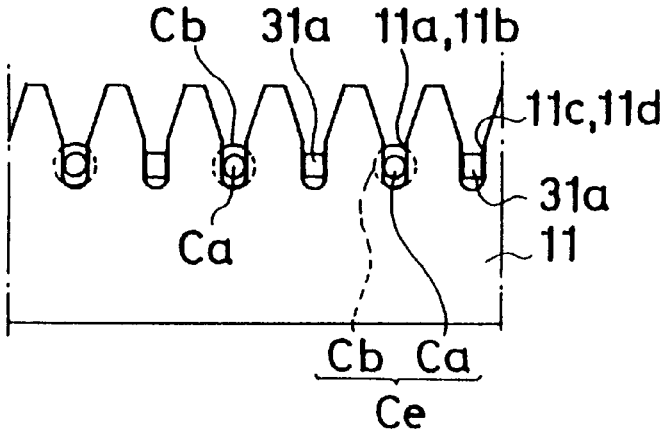
FIG. 5 is a view seen in the direction indicated by arrow V in FIG. 4.

The ferrule 33 are aligned in two rows, the front row and the rear row, on the main body 31*b*, and they are laterally aligned in a zigzag pattern such that the front ferrule 33*a* and the rear barrels 33*b* protrude one after the other laterally with a pitch P1 when viewed in the axial direction of the connector. The pitch P1 of the front and rear ferrule 33*a* and 33*b* equals the pitch P2 which is applied for positioning the grounding bars 31*a*, but the ferrule and the grounding bars are shifted by half the pitch, so one grounding bar 31*a* comes between any two adjacent ferrule 33*a* and 33*b* as shown in FIG. 3.

The grounding bars 31*a* of the lower grounding plate 31 are inserted into the slots 11*c* and 11*d* which are provided in the front and rear edges of the lower insulation displacement piece 11 and are retained there. After retaining the grounding plate 31 in the lower insulation displacement piece 11, the coaxial cables C are crimped in the ferrule 33 of the lower grounding plate 31. Prior to the crimping, the end portions of the coaxial cables C are stripped of the outer insulators C*d* to expose the shielding wires C*c*, and the end portions of the shielding wires C*c* are cut away to expose the signal lines C*e*. Then, the peripherals of the shielding wires C*c* are crimped in the ferrule 33.

In this example for the lower grounding plate 31, the coaxial cables C are not crimped in the ferrule 33 until the grounding plate 31 is mounted on the lower insulation displacement piece 11. However, only for the sake of description, FIG. 1 shows a coaxial cable C which is crimped in the left end ferrule 33.

The coaxial cables C are crimped to the lower grounding plate 31 in such a way that the front ends of the signal lines C*e* are in alignment with the front ends of the grounding bars 31*a*. As the ferrule 33 are positioned in the front and rear rows as described above, the coaxial cables C are prepared accordingly in two groups with different lengths of exposure of the signal lines C*e* as shown in the figures.

While the coaxial cables C with the shorter exposure of the signal lines C*e* are placed in the front barrels 33*a*, the coaxial cables C with the longer exposure of the signal lines C*e* are placed on the rear ferrule 33*b* (i.e., the coaxial cables C with the shorter exposure of the inner insulators C*b* and those with the longer exposure are placed one after the other). At the same time, the signal lines C*e* of all the coaxial cables C are inserted into and retained in the slots 11*a* and 11*b* which are provided in the lower insulation displacement piece 11 to retain the inner insulators C*b* of the coaxial cables.

After the shielding wires C*c* of the coaxial cables C are placed in the barrels 33 of the lower grounding plate 31, all the ferrule 33 are crimped on the shielding wires C*c* in one operation by using a crimping tool (not shown). As a result, the coaxial cables C are retained in alignment in the lower grounding plate 31, and the shielding wires C*c* of all the coaxial cables C are electrically connected through the lower grounding plate 31. Moreover, as shown in FIGS. 4 through 7, the signal lines C*e* of the coaxial cables C and the grounding bars 31*a* of the grounding plate 31 are positioned one after the other in the lower insulation displacement piece 11.

The lower insulation displacement piece 11 in this condition is mounted onto the housing 10 while the signal lines C*e* and the grounding bars 31*a* retained in the lower insulation displacement piece 11 are pressed into the contacts T of the housing 10. For this mounting, the lower insulation displacement piece 11 is provided with slots 11*e* and 11*f* to receive the contacts T at the positions which correspond with the respective positions of the contacts T in the housing.

Specifically, the signal contact receiving slots 11*e* are provided at the positions for receiving the signal contacts T1, which are brought into contact with the signal lines C*e* of the coaxial cables C. The grounding contact receiving slots 11*f* are provided at the positions for receiving the grounding contacts T2, which are brought into contact with the grounding bars 31*a* of the grounding plate 31.

Figure 6:
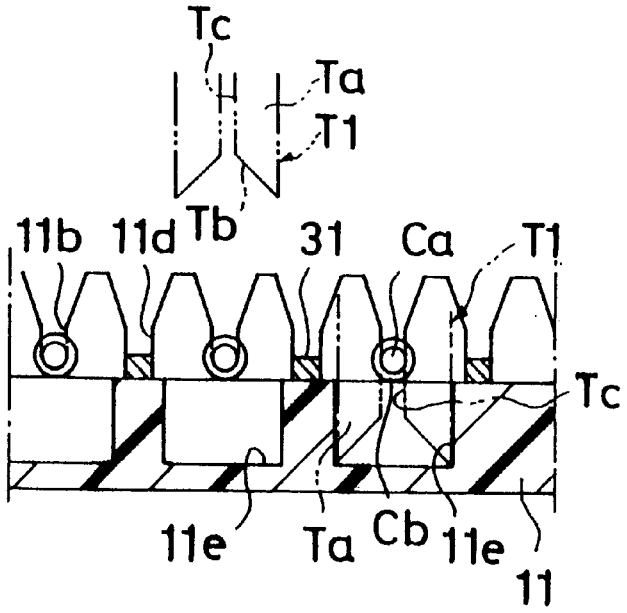
FIG. 6 is a view taken along line VI—VI in FIG. 4.

While the lower insulation displacement piece 11 is being mounted onto the housing 10, the inner insulators C*b* of the front end portions of the coaxial cables C hit the acute portions T*b* of the signal contacts T1 as shown in FIG. 6. The front end portions of the coaxial cables C are pushed toward the contact-aligning surface 10*a*, and the signal lines C*e* are squeezed into the signal contacts T1. In this instance, the acute portions T*b* of the signal contacts T1 strip the inner insulators C*b* and expose the inner conductors C*a* of the signal lines C*e*, and the inner surfaces of the slits T*c* of the signal contacts T1 come into contact with the inner conductors C*a*, establishing the electrical connection of the inner conductor C*a* of the signal line C*e* of each coaxial cable C to a respective signal contact T1 in the housing 10.

Figure 7:
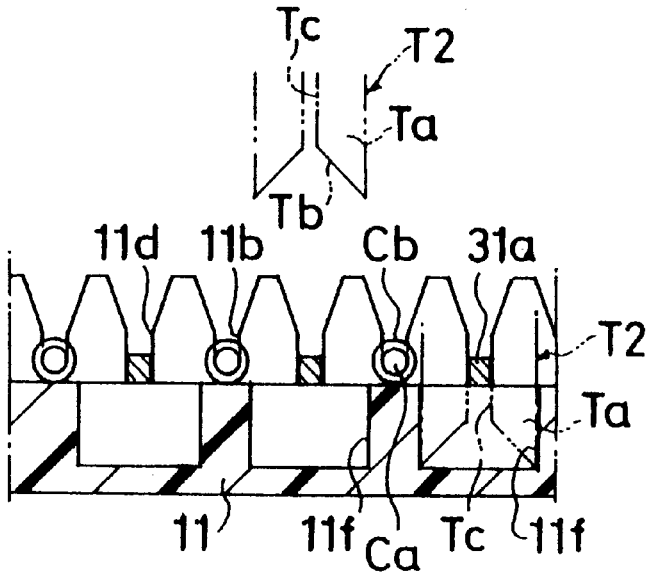
FIG. 7 is a view taken along line VII—VII in FIG. 4.
Figure 8A:
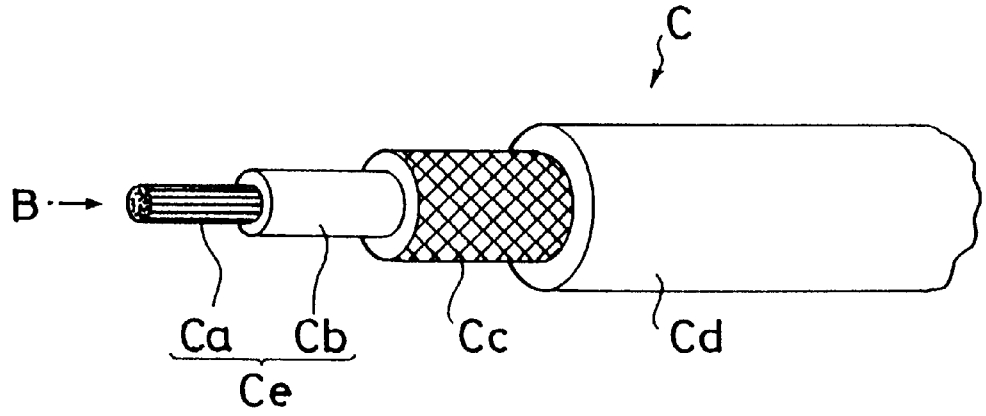
FIG. 8A is a perspective view of a coaxial cable.
Figure 8B:
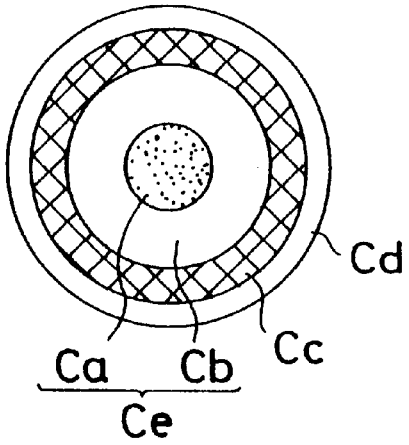
FIG. 8B is a view seen in the direction indicated by arrow B in FIG. 8A.
Figure 9:
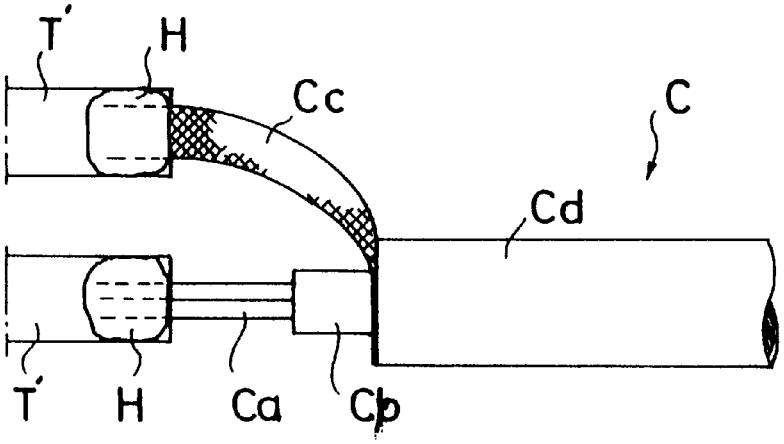
FIG. 9 shows a coaxial cable connected by a method of prior art.

At the same time, the grounding bars 31*a* of the lower grounding plate 31 also hit the acute portions T*b* of the grounding contacts T2 in the housing and are further pushed upward to secure the electrical connection of the grounding bars 31*a* to the grounding contacts T2 in the housing as shown in FIG. 7.

While the housing 10 and the lower insulation displacement piece 11 are held in a jig (not shown), the above mentioned assembly process is carried out by using a press (not shown). When this press fitting is performed, the insertion of the inner conductors C*a* and grounding bars 31*a* into the slits T*c* of the contacts T generates forces to act laterally to open the insulation displacement portions T*a* of the contacts T. However, the insulation displacement portions T*a* are retained firmly without lateral bending because, after the assembly, the lateral ends of the insulation displacement portions T*a* are held on the lateral inside surfaces of the contact receiving slots 11*e* and 11*f* of the lower insulation displacement piece 11. Therefore, the inner conductors C*a* and the grounding bars 31*a* are firmly connected to the insulation displacement portions T*a*.

Figure 2:
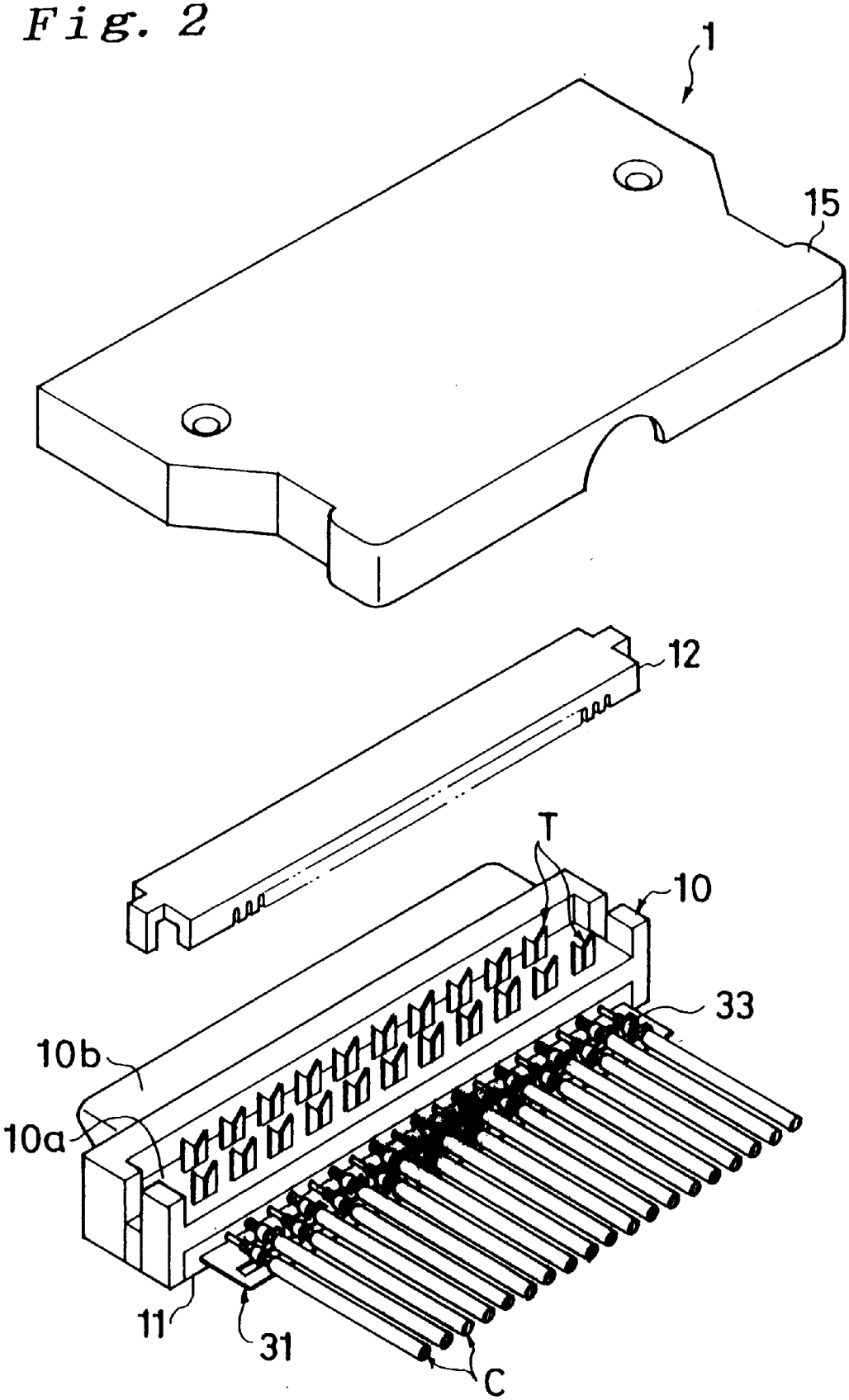
FIG. 2 is a perspective view of the whole of the connector.

FIG. 2 shows the condition that the lower insulation displacement piece 11 is mounted on the housing 10. The upper insulation displacement piece 12 is mounted onto the housing 10 in the same manner as the lower insulation displacement piece 11. The lower or upper insulation displacement piece 11 or 12 may be mounted onto the housing 10 as described above. However, it is optional whether the grounding plates 31 and 32 are assembled into the insulation displacement pieces 11 and 12 before or after the coaxial cables C are crimped in the ferrule 33 of the grounding plates 31 and 32 (refer to FIG. 1).

Now, the housing 10, which is mounted with the insulation displacement pieces 11 and 12 incorporating the grounding plates 31 and 32, is sandwiched with covers 15 from above and below (only the upper cover is shown in FIG. 2), completing the connector 1 which is capable of engaging with a matable connector.

In the above embodiment, one grounding bar 31*a* or 32*a* is positioned between any adjacent two coaxial cables C to prevent cross talks from occurring among the signal lines C*e* of the coaxial cables C. However, the present invention is not limited to this design because the grounding bars 31*a* and 32*a* are not necessarily required to be placed one bar for each space between two adjacent coaxial cables C in the alignment. Instead, each grounding plate may be provided with only one grounding bar, which is connected to a grounding contact of the connector 1.

Furthermore, in the above connector 1, the shielding wires C*c* of the coaxial cables C are connected to the grounding plates 31 and 32 by crimping the ferrule 33. However, the present invention is not limited to this design. For example, instead of the ferrule 33, the main bodies 31*b* and 32*b* of the grounding plates 31 and 32 may be provided with insulation displacement portions similar to those T*a* of the contacts T, and the shielding wires C*c* of coaxial cables can be electrically connected to the grounding plates 31 and 32 by squeezing the coaxial cables C into the insulation displacement portions and displacing the outer insulation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No.09-22917 filed on Feb. 5, 1997, which is incorporated herein by reference.

What is claimed is:

1. An insulation displacement connector for connecting with a matable connector a plurality of coaxial cables, each cable incorporating a signal line and shielding wires, said insulation displacement connector comprising:

a grounding plate which includes an elongate main body and grounding bars, said grounding bars extending transversely and forward from said main body;

a plurality of contacts, each contact including an insulation displacement portion at one end to which said grounding bar or said signal line is squeezed to establish electrical connection therewith, and a contact portion at another end which is brought into contact with a contact of said matable connector;

a housing, which retains said contacts in lateral alignment as a series extending in a longitudinal direction of the main body of the grounding plate; and an insulation displacement piece, which pushes said grounding bars and said signal lines to said insulation displacement portions;

wherein:

said main body also includes a connection retaining portion comprising a series of crimping ferrules located therealong to which said shielding wires are connected by crimping for retaining each said coaxial cable in alignment with each of said signal line extending transversely and forward from said main body and for establishing electrical connection between said shielding wires and said grounding bars, whereby both said grounding bars and said coaxial cables are maintained extending forward from said main body aligned in a row by the grounding plate so that the insulation displacement piece can push predetermined respective grounding bars and signal lines simultaneously into respective insulation displacement portion of said contacts to simultaneously establish electrical connection with respective contacts of the connector.

2. The insulation displacement connector set forth in claim 1 wherein when said coaxial cables are retained in said connection retaining portion, each of said grounding bars extend between adjacent of said signal lines to prevent cross-talk between adjacent signal lines.

3. The insulation displacement connector set forth in claim 1 wherein said grounding plate is made by punching a planar, electrically conductive material.

4. The insulation displacement connector set forth in claim 1 wherein:

said connection retaining portion is formed in a plurality of ferrule, each of which is formed by making incisions in the main body and bending cut pieces; and said shielding wires are exposed at front end portions of said coaxial cables, and said shielding wires are crimped in said barrel so that said shielding wires are connected to and retained in said connection retaining portion.

5. The insulation displacement connector set forth in claim 1 wherein the grounding plate is stamped and formed in one piece from a single strip of sheet metal stock.

6. The insulation displacement connector set forth in claim 1 wherein the crimping ferrules are aligned between respective adjacent grounding bars so that each of said grounding bars extend between adjacent of said signal lines to prevent cross-talk between adjacent signal lines.

7. An insulation displacement connector for connecting a plurality of coaxial cables with a matable connector, each cable incorporating a signal line and shielding wires, said insulation displacement connector comprising:

a metal grounding plate stamped and formed in one piece from which includes an elongate main body and grounding bars, said grounding bars extending transversely and forward from said main body and said main body also including a series of crimping ferrules which said shielding wires are connected by crimping for retaining each said coaxial cable with each of said signal lines extending transversely and forward from said main body and for establishing electrical connection between said shielding wires and said grounding bars, a plurality of contacts, each contact including an insulation displacement portion at one end to which said grounding bar or said signal line is squeezed to establish electrical connection therewith, and a contact portion at another end which is brought into contact with a contact of said matable connector;

a housing, which retains said contacts in lateral alignment as a series extending in a longitudinal direction of the main body of the grounding plate;

whereby both said grounding bars and said coaxial cables are maintained extending forward from said main body aligned in a row by the grounding plate so that predetermined respective grounding bars and signal lines can be pushed simultaneously into respective insulation displacement portions of said contacts to simultaneously establish electrical connection with respective contacts of the connector.

* * * * *